US008082864B2

(12) United States Patent
Nich

(10) Patent No.: US 8,082,864 B2
(45) Date of Patent: Dec. 27, 2011

(54) SEWING THREAD SPOOL HAVING THREAD LOCKING AND CUTTING FUNCTIONS

(76) Inventor: Jem Nich, Kowloon Bay (HK)

( * ) Notice: Subject to any disclaimer, the term of this patent is extended or adjusted under 35 U.S.C. 154(b) by 957 days.

(21) Appl. No.: 12/049,246

(22) Filed: Mar. 14, 2008

(65) Prior Publication Data

US 2009/0229502 A1 Sep. 17, 2009

(51) Int. Cl.
*B65H 54/18* (2006.01)

(52) U.S. Cl. ..... 112/279

(58) Field of Classification Search ..... 112/231, 112/233, 279, 227, 229, 254
See application file for complete search history.

(56) References Cited

U.S. PATENT DOCUMENTS 2,430,932 A * 11/1947 Hohmann ..... 112/270
4,259,914 A * 4/1981 Johnson ..... 112/184
4,275,675 A * 6/1981 Killinger ..... 112/229
5,109,782 A * 5/1992 Uyama ..... 112/184
5,921,192 A * 7/1999 Badillo ..... 112/231
6,152,057 A * 11/2000 Badillo ..... 112/229

* cited by examiner

*Primary Examiner* — Tejash Patel
(74) *Attorney, Agent, or Firm* — Intellectual Property Law Group LLP

(57) ABSTRACT

A sewing thread spool having thread locking and cutting functions is disclosed. The sewing thread spool comprises a winding core having an outer rim at one end and a bobbin at one end of the core, with a thread cutting plate arranged on an end plane of the bobbin. The bobbin comprises a thread-passing notch arranged at the end with the thread cutting plate. The thread cutting plate comprises a first and a second bayonet sockets separated from each other, the first bayonet socket cooperating with the thread-passing notch to produce a tension in a thread, and the second bayonet socket being used for cutting the thread and fixing the thread end. The thread spool is beneficial in that it cuts the thread and locks it to the spool.

18 Claims, 3 Drawing Sheets

SEWING THREAD SPOOL HAVING THREAD LOCKING AND CUTTING FUNCTIONS

BACKGROUND OF THE INVENTION

1. Field of the Invention

The present invention relates to a sewing thread spool, and more particularly to a sewing thread spool having thread locking and cutting functions.

2. Related Art

A traditional sewing thread spool only has thread winding and supplying functions. It cannot fix an end of a thread when storing the thread. Thus, the ends of the thread end in a tangle each time the sewing thread is used. Repeated tangle of the thread ends causes waste of material and time. There is also developed, a sewing thread spool with a clipping notch on an edge of an outer rim of a sewing thread spool. While such a spool appears to solve the above-mentioned thread end fixing problem to some extent, the clipping notch on the edge of such a thread spool tends to accidentally shave off a sewing thread that is in use, and the thread spool has to then be pulled or the thread is cut off with any other tool, making the thread spool inconvenient for a user to operate.

SUMMARY OF THE INVENTION

The object of the present invention is to provide a sewing thread spool having thread locking and cutting functions, so as to solve the technical problems with the above-mentioned prior sewing thread spool, i.e., the accidental shaving off of the thread in use, requiring the pulling or cutting of the thread end with another tool.

To resolve the technical problem mentioned above, the present invention provides a sewing thread spool having thread locking and cutting functions. The sewing thread spool comprises a spool and a thread cutting plate arranged on a plane end of the spool; wherein the bobbin comprises a thread-passing notch arranged at the end with the thread cutting plate; and the thread cutting plate comprises a first and a second bayonet sockets separated from each other; the first bayonet socket cooperating with the thread-passing notch to produce a tension in a thread, and the second bayonet socket being used for cutting the thread and fixing or locking the thread end.

In the sewing thread spool according to an embodiment of the present invention, the spool comprises a winding core and an outer rim that is connected at one end with the winding core. The thread-passing notch is positioned on an edge of the end of an outer rim, far away from the winding core.

In the sewing thread spool according to an embodiment of the present invention, the outer rim is a cylinder, and comprises a support ring and at least one fixing pillar, wherein the support ring extends in a ring form along the inner wall of the cylinder and protrudes towards the axis of the cylinder; the fixing pillar is positioned on the inner wall of the cylinder above the support ring, and protrudes towards the axis of the cylinder; and the fixing pillar is perpendicular to the support ring.

In the sewing thread spool of the present invention, the thread cutting plate is in a ring form, and its outer edge comprises at least one fixing notch matching with the fixing pillar, that fixes the thread cutting plate at the outer rim.

In the sewing thread spool of the present invention, when the thread cutting plate is arranged at the outer rim, the thread-passing notch is positioned between the first bayonet socket and the second bayonet socket.

In the sewing thread spool of the present invention, the first bayonet socket and the second bayonet socket comprise punched convexes on the thread cutting plate and the convexes are in a circle, oval or polygon form.

In the sewing thread spool of the present invention, the convex of the first bayonet socket protrudes in a direction contrary to that of the second bayonet socket.

In the sewing thread spool of the present invention, the thread-passing notch comprises a notch formed by an obtuse-angled bevel and an acute-angled bevel.

The sewing thread spool of the present invention thus has the beneficial advantage of thread locking and thread cutting because it is provided with the thread-passing notch on an edge of the outer rim, and the thread cutting plate comprises the first and the second bayonet sockets that can first tense the sewing thread and then cut it off.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 1:
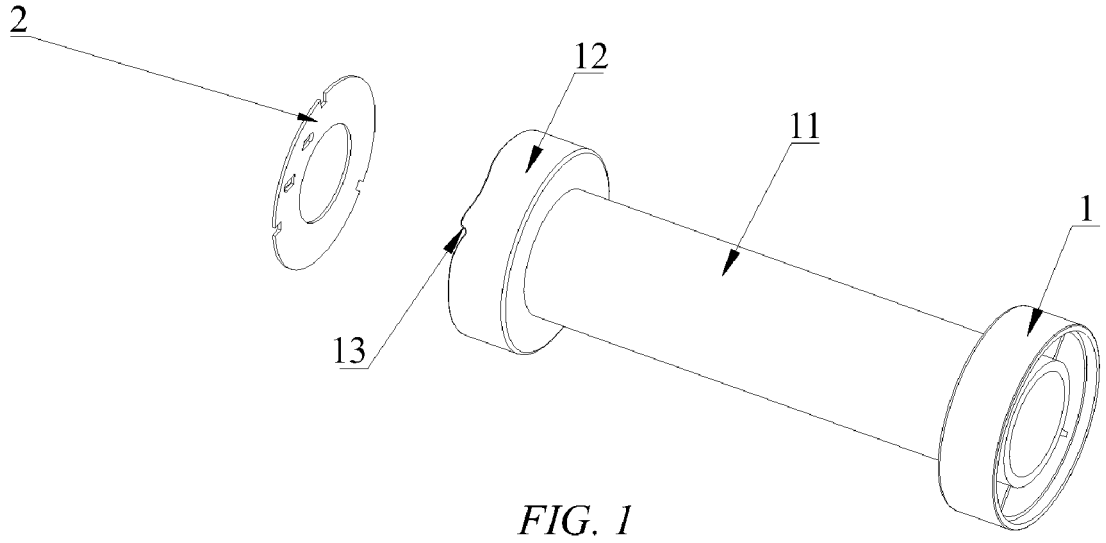
FIG. 1 is a structural schematic view of a first embodiment of the sewing thread spool having thread locking and cutting functions according to the present invention.
Figure 2:
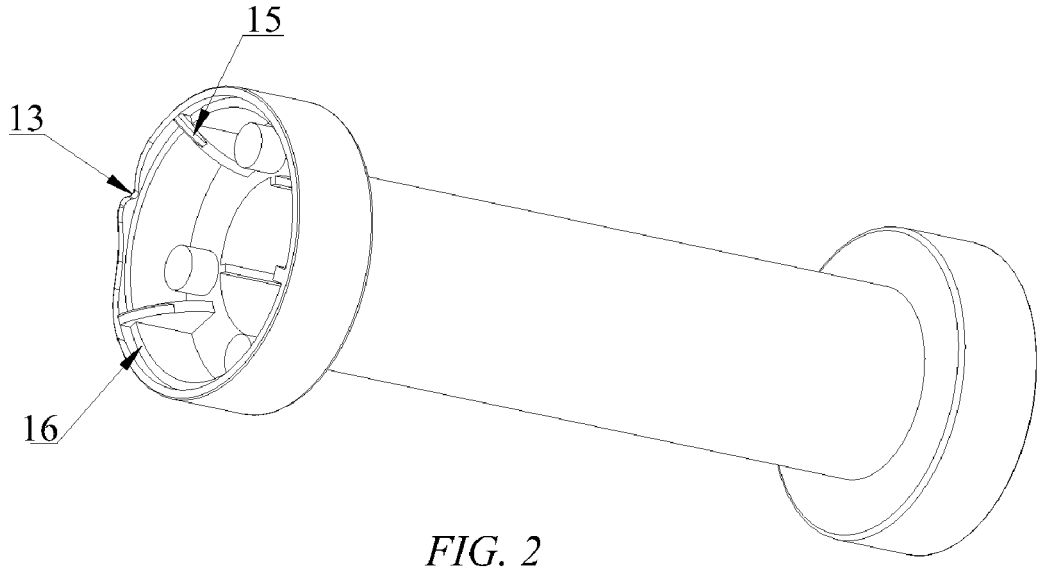
FIG. 2 is a structural schematic view of the bobbin in the first embodiment of the sewing thread spool having thread locking and cutting functions according to the present invention.

As shown in FIG. 1 and FIG. 2, a first embodiment of the sewing thread spool having thread locking and cutting functions according to the present invention comprises a bobbin 1 and a thread cutting plate 2. The bobbin 1 further comprises a winding core 11 having a cylindrical form and an outer rim 12 of cylindrical form having a bottom at which the winding core 11 is connected at an end. One or more thread-passing notches 13 is provided on an edge of the end of the outer rim 12, which is close to the thread cutting plate 2. The thread-passing notch 13 comprises two bevels tilting from a top surface of the outer rim 12 toward the winding core 11, one being an acute-angled bevel while the other being an obtuse-angled bevel. Said acute-angled bevel also forms an acute angle together with the ring where the lowest point of the thread-passing notch 13 is positioned. Similarly, said obtuse-angled bevel forms an obtuse angle with the ring where the lowest point of the thread-passing notch 13 is positioned.

The outer rim 12 is connected at the bottom with said winding core 11, with its top surface being the end closest to the thread cutting plate 2. On an inner wall of the cylindrical outer rim 12 is a support ring 16, which is positioned on said inner wall of the outer rim 12 and has a length that protrudes toward its circle center. The top surface of the support ring 16 is lower than that of the outer rim 12, so as to facilitate installation of the thread cutting plate 2 and make the thread cutting plate 2 substantially align with (or rest lower than) the top surface of the outer rim 12. A plurality of fixing pillars 15 are further arranged on the inner wall of the outer rim 12, so as to fix the thread cutting plate 2 substantially. In the first embodiment, three fixing pillars 15 are arranged on the inner wall of the outer rim 12 extending above the support ring 16 and have a length protruding toward the axis of the cylinder. The fixing pillars 15 are perpendicular in width to the support ring 16, and positioned at different locations of the support ring 16.

Figure 3:
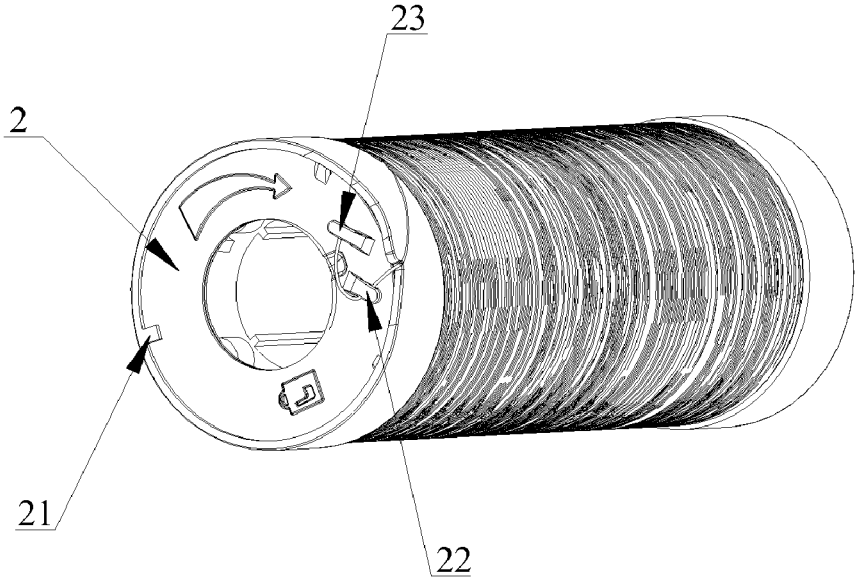
FIG. 3 is a schematic view of a relationship between the positions of the sewing thread and the thread cutting plate in the first embodiment of the sewing thread spool having thread locking and cutting functions according to the present invention.
Figure 4:
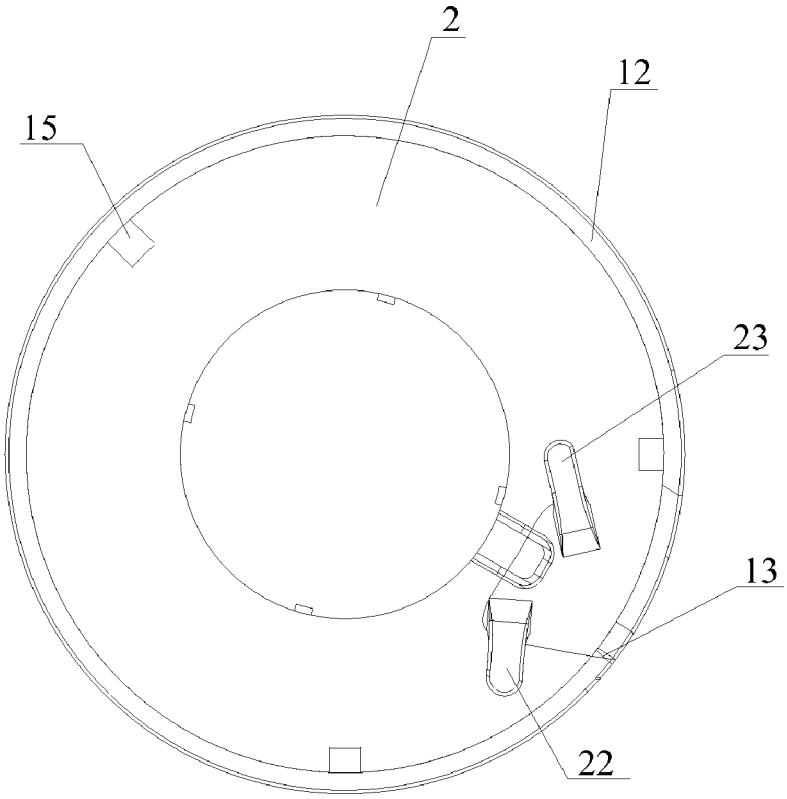
FIG. 4 is a top view of the thread spool in the first embodiment of the sewing thread spool having thread locking and cutting functions according to the present invention.

In a first embodiment of the present invention, as shown in FIG. 3 and FIG. 4, the thread cutting plate 2 comprises a first bayonet socket 22, a second bayonet socket 23 and at least one fixing notch 21, and is punched from a metal sheet. Because there are the three fixing pillars 15 on the outer rim 12 in the first embodiment, the thread cutting plate 2 also comprises three fixing notches 21 whose positions correspond to those of the three fixing pillars 15. The fixing notches 21 are positioned on an edge of the thread cutting plate 2, with sizes corresponding to those of the parts of the fixing pillars 15 beyond the support ring 16, so as to facilitate embedding the thread cutting plate 2 onto the outer rim 12 and fixating the thread cutting plate 2 in the outer rim 12 by the support ring 16 and the fixing pillar 15. When the thread cutting plate 2 is embedded in the outer rim 12, the thread-passing notch 13 is positioned between the first bayonet socket 22 and the second bayonet socket 23, which is realized through cooperation among positions of the fixing notch 21 and the fixing pillar 15, position of the thread-passing notch 13, as well as positions of the first bayonet socket 22 and the second bayonet socket 23. In the first embodiment, the first bayonet socket 22 and the second bayonet socket 23 are punched on the thread cutting plate 2, both being in an oval form and not punched off. In other words, when punched, only a large part of the oval is separated from the thread cutting plate 2, while the remaining part of the oval is still connected with or hanging from the thread cutting plate 2. The first bayonet socket 22 and the second bayonet socket 23 are configured by pulling up the part of the oval separated from the thread cutting plate 2. For the first bayonet socket 22 and the second bayonet socket 23, their convex parts separated from the thread cutting plate 2, normally are in a direction contrary to each other when viewed from the top of the thread cutting plate 2. For example, one socket opening part is on the left while the other one on the right, as shown in FIG. 4. Of course, the first bayonet socket 22 and the second bayonet socket 23 may also be in a circle or polygon form or other shapes in actual applications.

In the first embodiment of the present invention, as shown in FIG. 3, when the thread spool is in use, the sewing thread wound around the thread spool, after passing the thread-passing notch 13, winds through the first bayonet socket 22 and changes direction, and then winds through the second bayonet socket 23, thus making a user pull or cut off the thread end. In the above-mentioned process, the first bayonet socket 22 is used for creating tension in the sewing thread; and the second bayonet socket 23 is used for cutting off an end of the tensioned sewing thread when the thread spool rotates, and locking the end of the thread during the cutting process.

Figure 5:
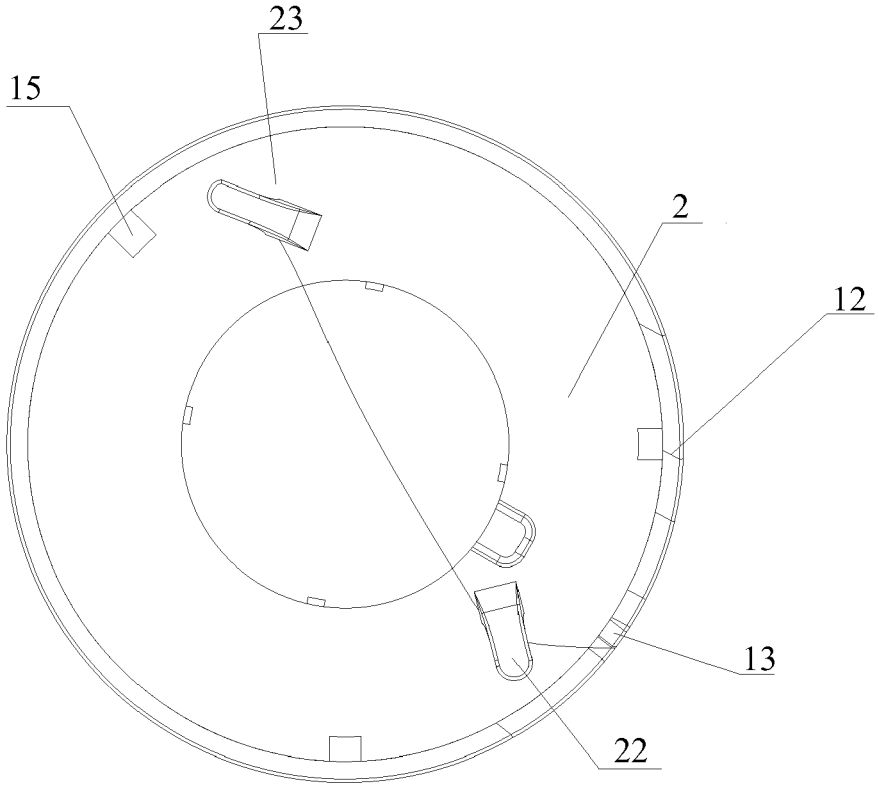
FIG. 5 is a top view of the thread spool of a second embodiment of the sewing thread spool having thread locking and cutting functions according to the present invention.
Figure 6:
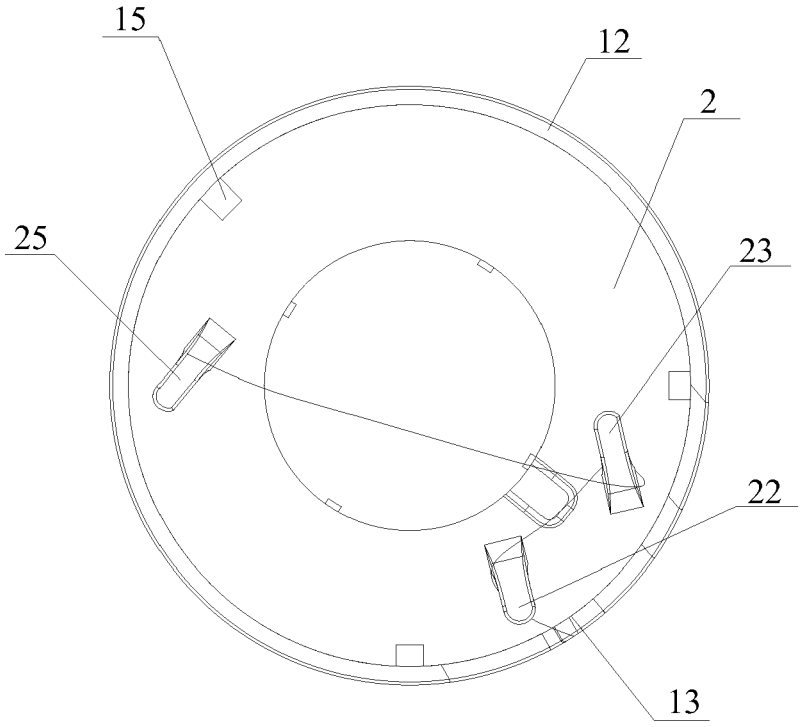
FIG. 6 is a top view of the thread spool of a third embodiment of the sewing thread spool having the thread locking and cutting functions according to the present invention.

FIG. 5 and FIG. 6 are top views of the thread spool of a second embodiment and a third embodiment of the present invention, respectively. The second embodiment and the third embodiment are the same as the first embodiment, except that the structure of the thread cutting plate 2 is different. The difference between the thread cutting plate 2 of the first embodiment and the thread cutting plate 2 of the second embodiment is the position of the second bayonet socket 23. In the second embodiment, the position of the second bayonet socket 23 is such that it aims at increasing the distance between the first bayonet socket 22 and the second bayonet socket 23, so as to make it convenient for the user to pick up the thread end. In FIG. 6, a third bayonet socket 25 is added in the third embodiment, which is at a farther distance away from the first bayonet socket 22 and the second bayonet socket 23. The sewing thread passes in sequence through the first bayonet socket 22, the second bayonet socket 23 and the third bayonet socket 25, which is likewise positioned to facilitate picking up of the thread end by the user. Of course, the sewing thread, before being used, can also pass through the first bayonet socket 22, then the third bayonet socket 25, and finally the second bayonet socket 23, and the result is the same.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

What is claimed is:

1. A sewing thread spool having thread locking and cutting functions, comprising:

a bobbin having a first end a thread cutting plate arranged at the first end of said bobbin; wherein a thread-passing notch is arranged on the first end of the bobbin near the thread cutting plate; and the thread cutting plate comprises a first bayonet socket and a second bayonet socket separated from each other, the first bayonet socket cooperating with the thread-passing notch to produce a tension in a thread applied to the spool, and the second bayonet socket configured for cutting the thread and fixing a thread end; wherein the bobbin comprises:

a winding core having a top end and connected between the first end of the bobbin and the thread cutting plate; and an outer rim connected with the top end of the winding core;

wherein the thread-passing notch is positioned on an edge of a distal end of the outer rim at a distance away from the winding core.

2. The sewing thread spool according to claim 1, wherein the outer rim is a cylindrical form, and comprises a support ring and at least one fixing pillar;

the support ring configured along an inner wall of the cylindrical outer rim and having a length protruding toward an axis of the cylindrical outer rim;

the fixing pillar is positioned on the inner wall of the cylindrical outer rim extending above the support ring having a width perpendicular to the support ring and a length protruding toward the axis of the cylindrical outer rim.

3. The sewing thread spool according to claim 2, wherein the thread cutting plate is in a ring form having an outer edge comprising at least one fixing notch matched with the at least one fixing pillar for fixing the thread cutting plate to the outer rim.

4. The sewing thread spool according to claim 3, wherein when the thread cutting plate is arranged at the outer rim, the thread-passing notch is positioned between the first bayonet socket and the second bayonet socket.

5. The sewing thread spool according to claim 4, wherein the first bayonet socket and the second bayonet socket comprise punched convexes on the thread cutting plate, and the convexes are shaped in a circle, oval or polygon form.

6. The sewing thread spool according to claim 5, wherein the convex of the first bayonet socket protrudes in a direction different from that of the second bayonet socket.

7. The sewing thread spool according to claim 1, wherein the thread-passing notch comprises at least a notch formed by an obtuse-angled bevel.

8. The sewing thread spool according to claim 2, wherein the thread-passing notch comprises at least a notch formed by an obtuse-angled bevel.

9. The sewing thread spool according to claim 3, wherein the thread-passing notch comprises at least a notch formed by an obtuse-angled bevel.

10. The sewing thread spool according to claim 4, wherein the thread-passing notch comprises at least a notch formed by an obtuse-angled bevel.

11. The sewing thread spool according to claim 5, wherein the thread-passing notch comprises at least a notch formed by an obtuse-angled bevel.

12. The sewing thread spool according to claim 6, wherein the thread-passing notch comprises at least a notch formed by an obtuse-angled bevel.

13. The sewing thread spool according to claim 1, wherein the thread-passing notch comprises at least a notch formed by an acute-angled bevel.

14. The sewing thread spool according to claim 2, wherein the thread-passing notch comprises at least a notch formed by an acute-angled bevel.

15. The sewing thread spool according to claim 3, wherein the thread-passing notch comprises at least a notch formed by an acute-angled bevel.

16. The sewing thread spool according to claim 4, wherein the thread-passing notch comprises at least a notch formed by an acute-angled bevel.

17. The sewing thread spool according to claim 5, wherein the thread-passing notch comprises at least a notch formed by an acute-angled bevel.

18. The sewing thread spool according to claim 6, wherein the thread-passing notch comprises at least a notch formed by an acute-angled bevel.

* * * * *